US005882696A

United States Patent [19]

Fabbri

[11] Patent Number: 5,882,696

[45] Date of Patent: Mar. 16, 1999

[54] TOOL-HOLDER FOR A TABLET MAKING MACHINE

[75] Inventor: Guido Bruno Fabbri, deceased, late of Bondeno, Italy, by Paola Fabbri Rovatti, Francesco Fabbri, Gabriele Fabbri and Giulia Fabbri, legal representatives

[73] Assignee: I.M.A. Industria Macchine Automatiche S.p.A., Ozzano Emilia, Italy

[21] Appl. No.: 669,443

[22] PCT Filed: Jan. 26, 1995

[86] PCT No.: PCT/IT95/00007

§ 371 Date: Apr. 23, 1997

§ 102(e) Date: Apr. 23, 1997

[87] PCT Pub. No.: WO95/20484

PCT Pub. Date: Aug. 3, 1995

[30] Foreign Application Priority Data

Jan. 31, 1994 [IT] Italy ..... B094A011 U

[51] Int. Cl.[6] ..... B30B 11/08

[52] U.S. Cl. ..... 425/186; 425/193; 425/345; 425/353

[58] Field of Search ..... 425/193, 259, 425/345, 186, 348 R, 352, 353, 354, 355

[56] References Cited

U.S. PATENT DOCUMENTS 3,507,009 4/1970 Comly .
4,475,880 10/1984 Crossley et al. ..... 425/345
5,022,256 6/1991 van der Meulen .
5,071,607 12/1991 Ayer et al. ..... 425/345
5,462,427 10/1995 Kramer ..... 425/345

FOREIGN PATENT DOCUMENTS 1 427 431 3/1969 Germany .
1 552 997 9/1969 Germany .

*Primary Examiner*—Patrick Ryan
*Assistant Examiner*—Joseph Leyson
*Attorney, Agent, or Firm*—Nims, Howes, Collison, Hansen & Lackert

[57] ABSTRACT

A stamping device for a tablet making machine includes a pair of coaxial stamping heads (1) which enter, on opposing faces, a matrix carried by a matrix plate (2) formed around a rotary turret (3), a pair of punches (4) which are guided by respective holes made in the turret (3) and which are adapted to be coupled with the stamping heads (1) in axial alignment therewith, and a coupling (13) for joining the stamping head (1) and the respective punches (4). The device includes also a locking mechanism (6), which comprise a screw member (7) passing through a transverse hole (8) made close to the end of the respective punch (4). The screw member (7) has a head (9) having a concentric semi-spherical section (10) that matches a complementary recess connected to the outer surface of the respective punch (4).

4 Claims, 2 Drawing Sheets

TOOL-HOLDER FOR A TABLET MAKING MACHINE

TECHNICAL FIELD

The present invention relates to a tablet making machine.

BACKGROUND ART

Currently, tablet making machines are known in which material to be compressed in powder or granular form, is supplied to the inner room of each matrix of a matrix assembly that is fixed peripherally to a rotary turret.

Each die matrix is entered, on opposing faces, by a pair of stamping heads which are secured to respective punches.

The punches of each pair of stamping heads are guided by respective coaxial holes made along the periphery of the rotary turret.

The punches are activated axially by suitable driving means, including e.g. cam means, which control the position of the punches upon rotation of the turret for each working cycle.

In particular, the Italian Patent Application No. 3514A/90, owned by the Applicant, describes a machine of the type as mentioned, in which there are means for coupling the stamping heads with the respective punches, and means provided in the punches for locking the coupling means.

The stamping heads are secured to, or released from, the punches by tightening or releasing the locking means.

The above mentioned locking means include a screw member that passes through a transverse hole made in the respective punch and that engages wedging means made in form of a wedge that enters an indentation made in the stamping head.

The compressing device has achieved good results, and in particular allows for quick and easy change over of the heads, so that tablets with different sizes can be produced.

However, the rigid locking of the coupling means with respect to the punches may bring about damaging stress.

For example, the coupling means may be displaced while engaging the stamping heads, and the displacement would also concern the locking means.

DISCLOSURE OF THE INVENTION

The object of the present invention is to provide an improved compressing device for a tablet making machine, that allows for a very good coupling between the punches and the stamping heads, while preventing possible damaging stress.

The above mentioned object is obtained by means of an improved stamping device for a tablet making machine, including a matrix plate formed around a rotary turret, at least a pair of coaxial punches which are guided for axial motion by respective holes made in the turret, at least a pair of stamping heads adapted to be respectively coupled with said punches in axial alignment therewith, so as to enter and exit a respective matrix of said matrix plate due to vertical motion of the respective punches, coupling means for securing each stamping head to a respective punch, and locking means for each punch in lock said coupling means to a position in which the respective stamping head is joined to the respective punch.

Each locking means includes a screw member that passes through a transverse hole made in said punch, the screw member having a head having a concentric semi-spherical section that matches a complementary recess connected to the outer surface of the respective punch.

BRIEF DESCRIPTION OF THE DRAWINGS

The characteristic features of the present invention are pointed out in the following with reference to the enclosed drawings, in which.

BEST MODE OF CARRYING OUT THE INVENTION

Figure 1:
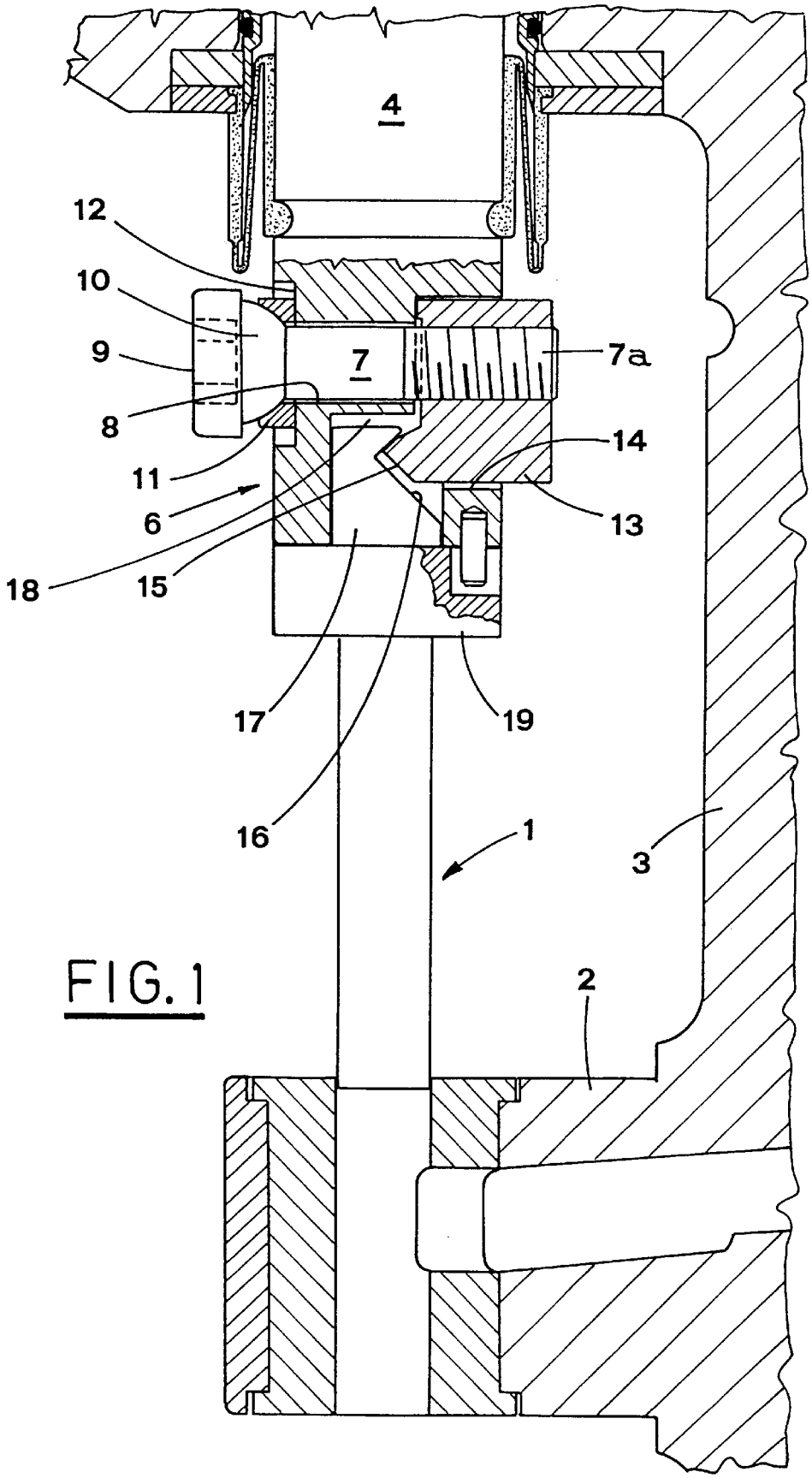
FIG. 1 shows a vertical sectional view of the compressing device, in which only one compressing head is illustrated.

With reference to the above mentioned figures, reference numeral 1 indicates an upper stamping head of the improved compressing device.

The stamping head 1 is moved, in a known manner, to enter a respective matrix carried by a table 2 formed in a periphery extension of a rotary turret 3 of the tablet making machine.

In fact, the table 2 of the rotary turret 3 carries a plurality of matrices which are regularly spaced apart along its periphery.

Each matrix delimits a room that is engaged, at both opposing faces, by a pair of coaxial stamping heads 1, i.e. an upper head and a lower head.

In the drawing there is shown, for the sake of simplicity, only the upper stamping head, since the lower one is identical.

The stamping head 1 is axially coupled with a respective punch 4, guided in a related vertical hole made in the turret 3.

The stamping head 1 is secured to the punch 4, in its proper position, by a locking means generally indicated by numeral 6.

This locking means include a screw member 7 that passes through a transverse hole 8 made in the head 1 close to the end of the punch 4.

It will be noted that the hole 8 has a diameter bigger than the screw member 7, so that the screw member has a certain clearance around it.

The head 9 of the screw member 7 features a concentric semispherical section 10 close to the body.

The semispherical section 10 fits a complementary recess made on a ring 11 positioned between the head 9 and a suitable flat section 12 made on the outer surface of the punch 4.

The threaded end 7*a* of the screw member 7 engages a correspondent threaded hole made in a coupling means 13 of the stamping head.

The coupling means 13 is formed by a protrusion entering a longitudinal slot 14 that is made in the punch 4 and that is in communication with the transverse hole 8.

The coupling means 13 features a wedge section 15 that enters an indentation 16 made in the shank 17 of the stamping head.

The shank 17 is inserted into an axial hole 18 that is made in the punch 4 and that opens to the slot 14.

A flange 19, having a diameter bigger than the diameter of the head, is made in the stamping head, close to the shank 17.

This flange 19 is linked to the punch 4 by a pin 30 that prevents the stamping head from rotating The described compressing device allows for a quick change over of the stamping heads to produce tablets with different size, in that the heads are locked by a limited number of screw means.

The size change over does not require the change of the punches that are guided on the rotary turret and are driven by the driving means.

In particular, the coupling means 13 allows for a rapid locking of the stamping head by making the wedge 15 enter the indentation 16 made in the shank 17 introduced in the end of the punch 4.

Figure 2:
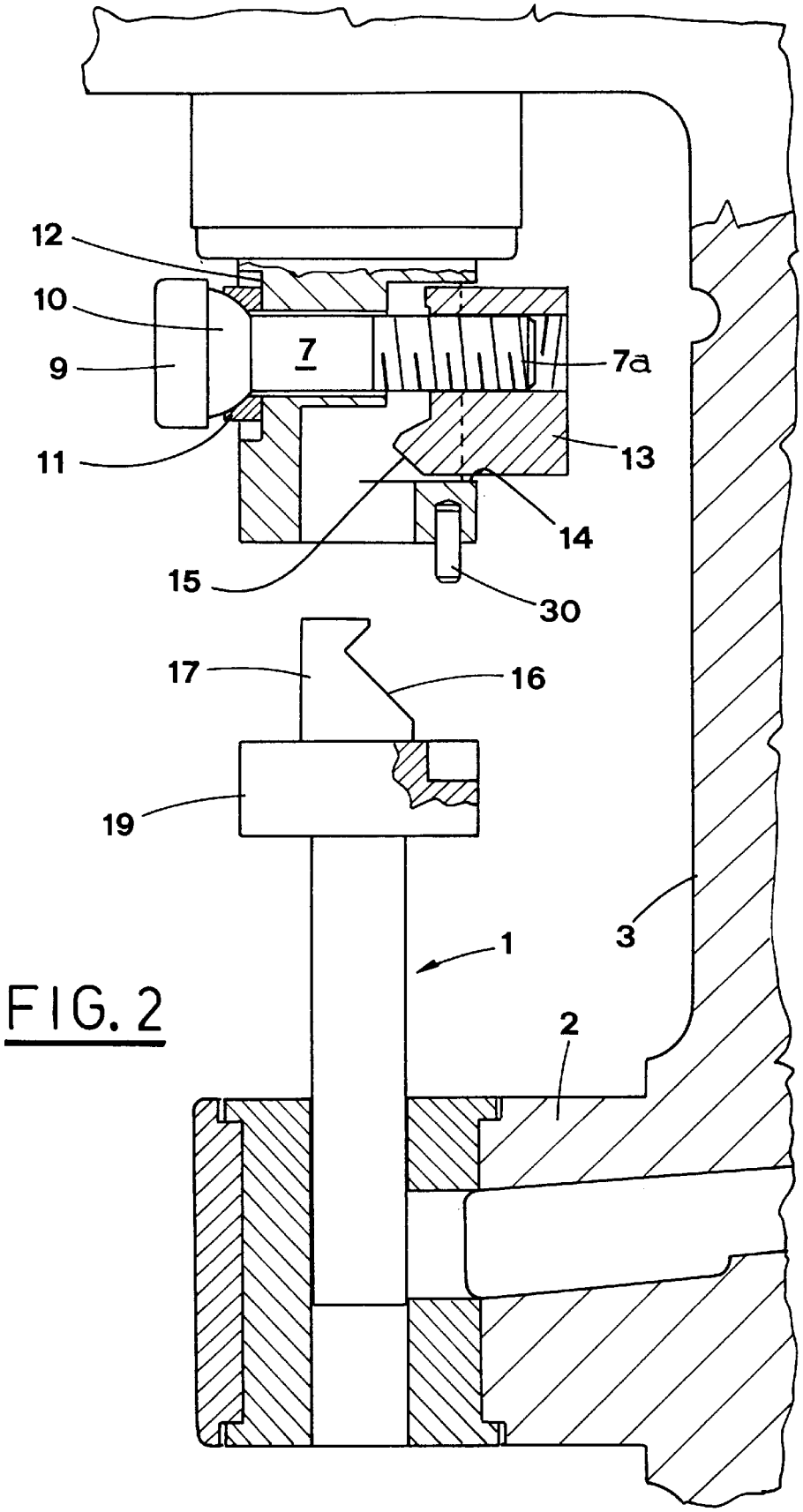
FIG. 2 shows a corresponding sectional view of the device when the stamping head is removed from the punch.

The locking action of the screw member 7 on the coupling means 13 begins from the stamping head extraction position, in which the wedge 15 is disengaged from the indentation 16 (see FIG. 2).

It is to be pointed out that the spherical fit of the section 10, made in the head 9 of the screw member 7, with the ring 11 and clearance of the body of the screw member 7 in the hole 8 allows the same screw member 7 to oscillate slightly.

Therefore, if in the tightening phase the coupling means 13 are displaced, this displacement is automatically compensated by the screw member 7 that changes its angular position.

Consequently, the improved compressing device allows for a very good coupling between the punches and stamping heads, preventing possible damaging stress.

It is understood that what above has been described is a mere, not limitative example, therefore all possible constructive variants are protected by the present technical solution, as described above and claimed in the following.

I claim:

1. A stamping device for a tablet making machine, including a matrix plate (2) formed around a rotary turret (3), at least a pair of coaxial punches (4) which are guided for axial motion by respective holes made in the turret (3), at least a pair of stamping heads (1) adapted to be respectively coupled with said punches (4) in axial alignment therewith, so as to enter and exit a respective matrix of said matrix plate due to vertical motion of the respective punches, coupling means (13) for securing each stamping head (1) to a respective punch (4), and locking means (6) provided for each punch (4) to lock said coupling means when the respective stamping head (1) is joined to the respective punch (4), the device being characterized in that each locking means (6) includes a screw member (7) that passes through a transverse hole (8) made in said punch (4), said screw member (7) having a head (9) having a concentric semi-spherical section (10) that mates with a complementary recess connected to an outer surface of the respective punch (4).

2. Device according to claim 1, characterized in that said hole (8) has a diameter bigger than said screw member (7), so that the screw member has a clearance around it.

3. Device according to claim 1, characterized in that each stamping head (1) has a flange (19), coupled with the punch (4) by a pin (30) that prevents the stamping head from rotating with respect to the punch (4).

4. Device according to claim 1, wherein the respective punch has a flat section (12) made on the outer surface thereof, a ring (11) positioned on said flat section, the ring having the complementary recess for receiving the semi-spherical section (10) of said screw member (7).

* * * * *